US010475363B2

(12) United States Patent
Chen et al.

(10) Patent No.: US 10,475,363 B2
(45) Date of Patent: Nov. 12, 2019

(54) DISPLAYS WITH ADAPTIVE SPECTRAL CHARACTERISTICS

(71) Applicant: Apple Inc., Cupertino, CA (US)

(72) Inventors: Cheng Chen, San Jose, CA (US); Deniz Teoman, San Mateo, CA (US); Jiaying Wu, San Jose, CA (US); John Z. Zhong, Cuptertino, CA (US); Jun Jiang, Campbell, CA (US)

(73) Assignee: Apple Inc., Cupertino, CA (US)

( * ) Notice: Subject to any disclaimer, the term of this patent is extended or adjusted under 35 U.S.C. 154(b) by 503 days.

(21) Appl. No.: 14/500,458

(22) Filed: Sep. 29, 2014

(65) Prior Publication Data

US 2015/0348468 A1 Dec. 3, 2015

Related U.S. Application Data

(60) Provisional application No. 62/006,781, filed on Jun. 2, 2014.

(51) Int. Cl.
*G09G 3/34* (2006.01)
*G09G 3/20* (2006.01)

(52) U.S. Cl.
CPC ..... *G09G 3/2003* (2013.01); *G09G 3/3406* (2013.01); *G09G 3/3413* (2013.01);
(Continued)

(58) Field of Classification Search
CPC ..... G09G 3/20; G09G 3/36; G09G 3/3406; H01L 27/3213; A61M 21/02; A61N 5/06; F21K 9/00; H05B 33/0842
See application file for complete search history.

(56) References Cited

U.S. PATENT DOCUMENTS 5,387,920 A * 2/1995 Bos ..... G02F 1/13473 345/88
6,690,351 B1 2/2004 Wong
(Continued)

FOREIGN PATENT DOCUMENTS

CN 101765878 A 6/2010
CN 103512655 A 1/2014
(Continued)

OTHER PUBLICATIONS

"White Balance Control Methods on Liquid Crystal Display", IBM Technical Disclosure Bulletin, International Business Machines Corp, (Thornwood) US, vol. 37, No. 11, Nov. 1, 1994, p. 425/426, XP000487289, ISSN:0018-8689.
(Continued)

*Primary Examiner* — Lunyi Lao
*Assistant Examiner* — Johny Lau
(74) *Attorney, Agent, or Firm* — Treyz Law Group, P.C.; Kendall W. Abbasi

(57) ABSTRACT

An electronic device may include a display having an array of display pixels and having display control circuitry that controls the operation of the display. The display control circuitry may adaptively adjust the spectral characteristics of display light emitted from the display to achieve a desired effect on the human circadian system. For example, the display control circuitry may adjust the spectral characteristics of blue light emitted from the display based on the time of day such that a user's exposure to the display light may result in a circadian response similar to that which would be experienced in natural light. The spectral characteristics of blue light emitted from the display may be adjusted by adjusting the relative maximum power levels provided to blue pixels in the display or by shifting the peak wavelength associated with blue light emitted from the display.

11 Claims, 10 Drawing Sheets

(52) U.S. Cl.
CPC ... *G09G 2310/08* (2013.01); *G09G 2320/064* (2013.01); *G09G 2320/0633* (2013.01); *G09G 2320/0666* (2013.01); *G09G 2320/08* (2013.01); *G09G 2360/144* (2013.01)

(56) References Cited

U.S. PATENT DOCUMENTS

| | | | | |
|---|---|---|---|---|
| 7,934,853 | B2 | 5/2011 | Coombs et al. | |
| 8,646,939 | B2 | 2/2014 | Bues et al. | |
| 2006/0104058 | A1* | 5/2006 | Chemel | H05B 33/0842 362/231 |
| 2007/0268234 | A1* | 11/2007 | Wakabayashi | A61M 21/00 345/102 |
| 2009/0281604 | A1* | 11/2009 | De Boer | A61M 21/00 607/88 |
| 2010/0110672 | A1 | 5/2010 | Durand et al. | |
| 2012/0259392 | A1* | 10/2012 | Feng | A61N 5/0618 607/88 |
| 2013/0165741 | A1* | 6/2013 | Seabury | A61M 21/02 600/27 |
| 2013/0218240 | A1* | 8/2013 | Feng | A61N 5/0618 607/90 |
| 2014/0254139 | A1* | 9/2014 | Park | G09G 3/20 362/97.1 |
| 2014/0277297 | A1* | 9/2014 | Harris | A61N 5/0621 607/90 |
| 2014/0353636 | A1* | 12/2014 | Baek | H01L 27/3213 257/40 |

FOREIGN PATENT DOCUMENTS

| | | | |
|---|---|---|---|
| JP | 2005063687 | A | 3/2005 |
| JP | 2009533127 | A | 9/2009 |
| JP | 2010250140 | A | 11/2010 |
| JP | 2012524369 | A | 10/2012 |
| JP | 2013024997 | A | 2/2013 |
| JP | 2014006759 | A | 1/2014 |
| WO | 2004088616 | A1 | 10/2004 |

OTHER PUBLICATIONS

Figueiro et al., "Spectral sensitivity of the circadian system", Proc. SPIE 5187, Third International Conference on Solid State Lighting, 207, Jan. 26, 2004 [Retrieved on May 26, 2014]. Retrieved from the Internet<URL:https://www.sad.co.uk/resources/SAD_Research/SAD_Light_Effect_On_Circadian_Rhythms.pdf>.

* cited by examiner

DISPLAYS WITH ADAPTIVE SPECTRAL CHARACTERISTICS

This application claims the benefit of provisional patent application No. 62/006,781, filed Jun. 2, 2014, which is hereby incorporated by reference herein in its entirety.

BACKGROUND

This relates generally to electronic devices with displays and, more particularly, to electronic devices with displays having adaptive spectral characteristics.

The human circadian system may respond differently to different wavelengths of light. For example, when a user is exposed to blue light having a peak wavelength within a particular range, the user's circadian system may be activated and melatonin production may be suppressed. On the other hand, when a user is exposed to light outside of this range of wavelengths or when blue light is suppressed (e.g., compared to red light), the user's melatonin production may be increased, signaling nighttime to the body.

Conventional displays do not take into account the spectral sensitivity of the human circadian rhythm. For example, some displays emit light having spectral characteristics that trigger the circadian system regardless of the time of day, which can in turn have an adverse effect on sleep quality.

It would therefore be desirable to be able to provide improved ways of displaying images with displays.

SUMMARY

An electronic device may include a display having an array of display pixels and having display control circuitry that controls the operation of the display. The display control circuitry may adaptively adjust the spectral characteristics of display light emitted from the display to achieve a desired effect on the human circadian system. For example, the display control circuitry may adjust the spectral characteristics of blue light emitted from the display based on the time of day such that a user's exposure to the display light may result in a circadian response similar to that which would be experienced in natural light.

Other factors that may be taken into account when adjusting the spectral characteristics of display light include geographic location, time of year, season, ambient light, user input, and user preferences.

The spectral characteristics of blue light emitted from the display may be adjusted by adjusting the relative maximum power levels provided to blue pixels in the display or by shifting the peak wavelength associated with blue light emitted from the display.

Further features of the invention, its nature and various advantages will be more apparent from the accompanying drawings and the following detailed description of the preferred embodiments.

DETAILED DESCRIPTION

Electronic devices such as cellular telephones, media players, computers, set-top boxes, wireless access points, and other electronic equipment may include displays. Displays may be used to present visual information and status data and/or may be used to gather user input data.

Figure 1:
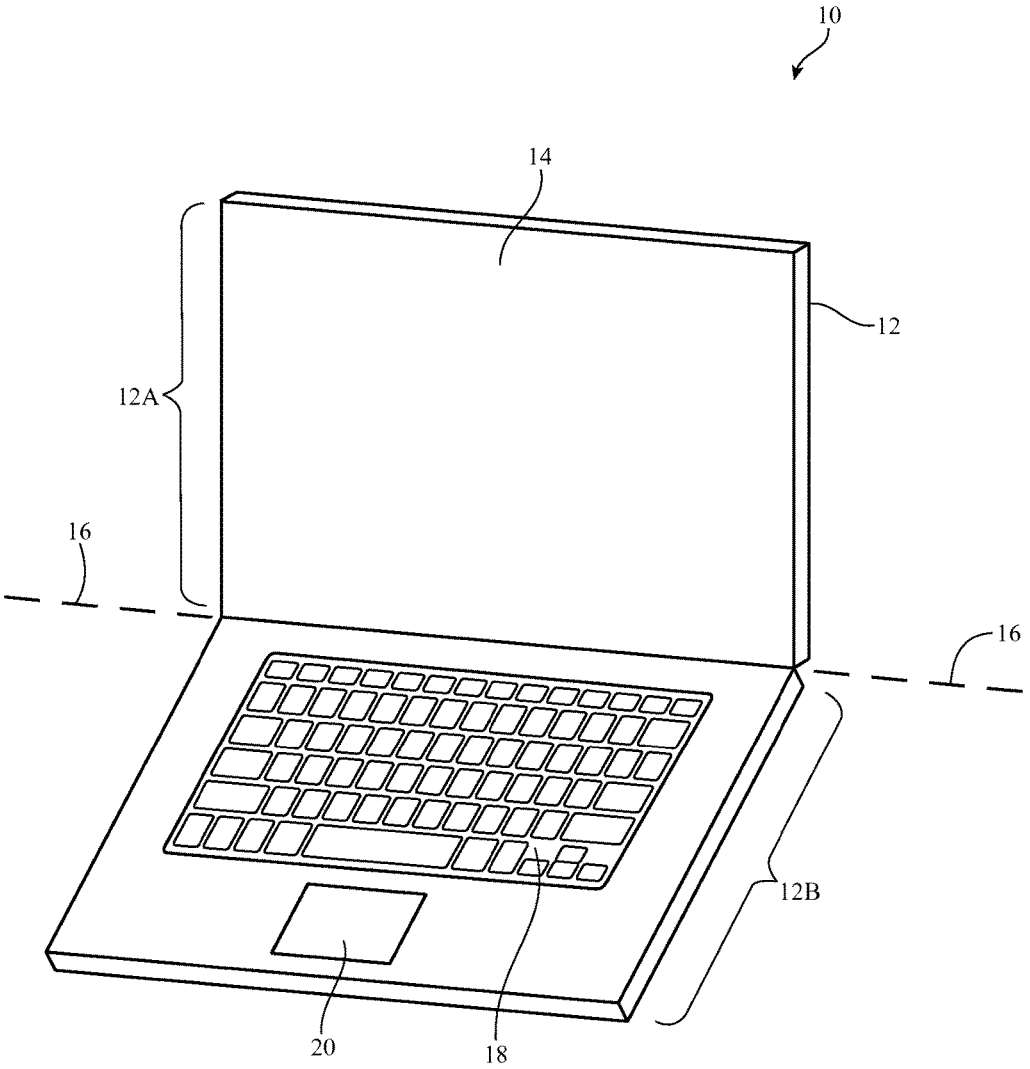
FIG. 1 is a perspective view of an illustrative electronic device such as a portable computer having a display in accordance with an embodiment of the present invention.

An illustrative electronic device of the type that may be provided with a display having an adaptive color gamut is shown in FIG. 1. Electronic device 10 may be a computer such as a computer that is integrated into a display such as a computer monitor, a laptop computer, a tablet computer, a somewhat smaller portable device such as a wrist-watch device, pendant device, or other wearable or miniature device, a cellular telephone, a media player, a tablet computer, a gaming device, a navigation device, a computer monitor, a television, or other electronic equipment.

As shown in FIG. 1, device 10 may include a display such as display 14. Display 14 may be a touch screen that incorporates capacitive touch electrodes or other touch sensor components or may be a display that is not touch-sensitive. Display 14 may include image pixels formed from light-emitting diodes (LEDs), organic light-emitting diodes (OLEDs), plasma cells, electrophoretic display elements, electrowetting display elements, liquid crystal display (LCD) components, or other suitable image pixel structures. Arrangements in which display 14 is formed using organic light-emitting diode pixels are sometimes described herein as an example. This is, however, merely illustrative. Any suitable type of display technology may be used in forming display 14 if desired.

Device 10 may have a housing such as housing 12. Housing 12, which may sometimes be referred to as a case, may be formed of plastic, glass, ceramics, fiber composites, metal (e.g., stainless steel, aluminum, etc.), other suitable materials, or a combination of any two or more of these materials.

Housing 12 may be formed using a unibody configuration in which some or all of housing 12 is machined or molded as a single structure or may be formed using multiple structures (e.g., an internal frame structure, one or more structures that form exterior housing surfaces, etc.).

As shown in FIG. 1, housing 12 may have multiple parts. For example, housing 12 may have upper portion 12A and lower portion 12B. Upper portion 12A may be coupled to lower portion 12B using a hinge that allows portion 12A to rotate about rotational axis 16 relative to portion 12B. A keyboard such as keyboard 18 and a touch pad such as touch pad 20 may be mounted in housing portion 12B.

Figure 2:
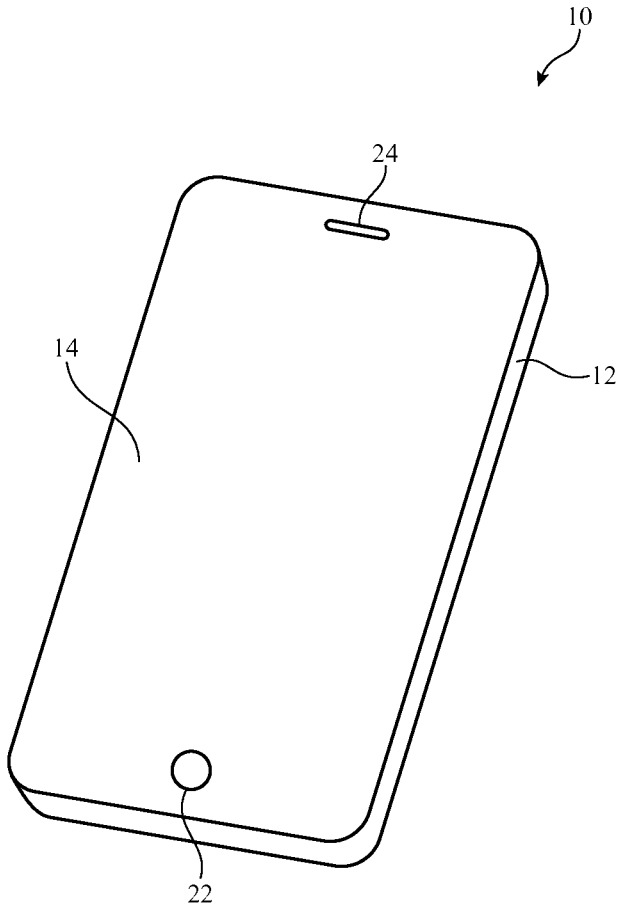
FIG. 2 is a perspective view of an illustrative electronic device such as a cellular telephone or other handheld device having a display in accordance with an embodiment of the present invention.

In the example of FIG. 2, device 10 has been implemented using a housing that is sufficiently small to fit within a user's hand (e.g., device 10 of FIG. 2 may be a handheld electronic device such as a cellular telephone). As show in FIG. 2, device 10 may include a display such as display 14 mounted on the front of housing 12. Display 14 may be substantially filled with active display pixels or may have an active portion and an inactive portion. Display 14 may have openings (e.g., openings in the inactive or active portions of display 14) such as an opening to accommodate button 22 and an opening to accommodate speaker port 24.

Figure 3:
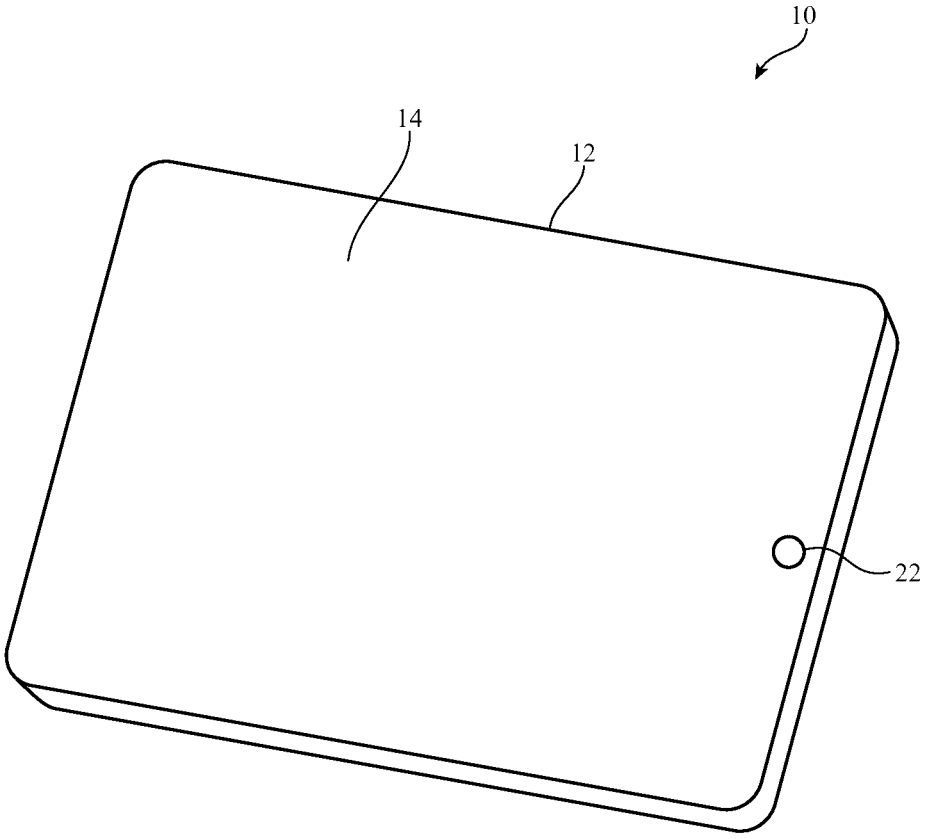
FIG. 3 is a perspective view of an illustrative electronic device such as a tablet computer having a display in accordance with an embodiment of the present invention.

FIG. 3 is a perspective view of electronic device 10 in a configuration in which electronic device 10 has been implemented in the form of a tablet computer. As shown in FIG. 3, display 14 may be mounted on the upper (front) surface of housing 12. An opening may be formed in display 14 to accommodate button 22.

Figure 4:
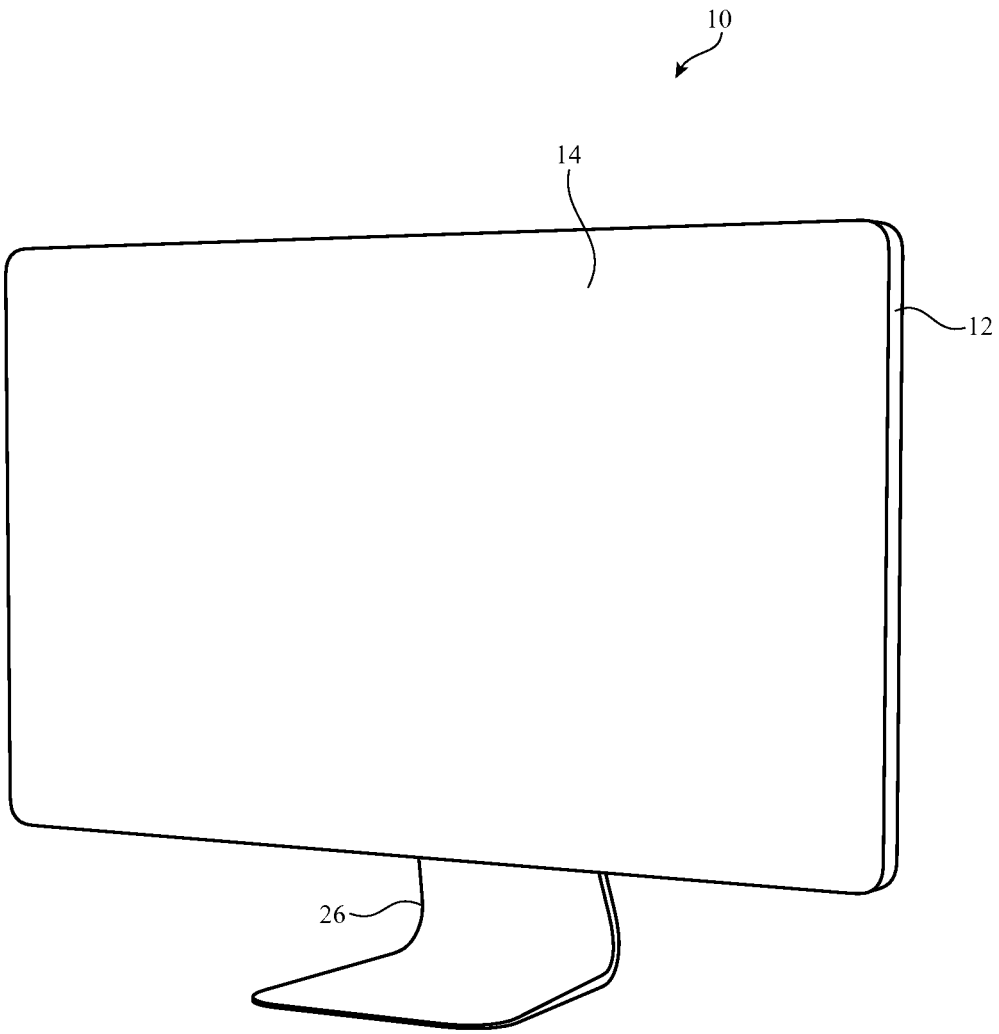
FIG. 4 is a perspective view of an illustrative electronic device such as a computer monitor with a built-in computer having a display in accordance with an embodiment of the present invention.

FIG. 4 is a perspective view of electronic device 10 in a configuration in which electronic device 10 has been implemented in the form of a computer integrated into a computer monitor. As shown in FIG. 4, display 14 may be mounted on a front surface of housing 12. Stand 26 may be used to support housing 12.

Figure 5:
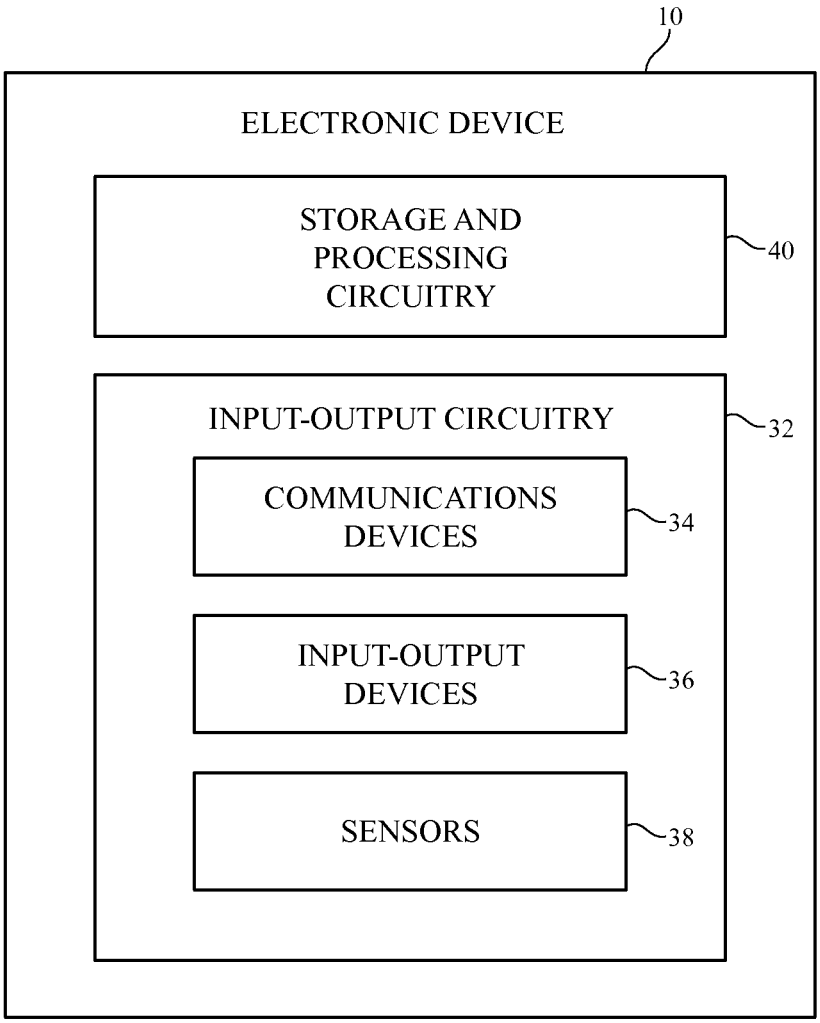
FIG. 5 is a schematic diagram of an illustrative system including an electronic device of the type that may be provided with a display having an adaptive color gamut in accordance with an embodiment of the present invention.

A schematic diagram of device 10 is shown in FIG. 5. As shown in FIG. 5, electronic device 10 may include control circuitry such as storage and processing circuitry 40. Storage and processing circuitry 40 may include one or more different types of storage such as hard disk drive storage, nonvolatile memory (e.g., flash memory or other electrically-programmable-read-only memory), volatile memory (e.g., static or dynamic random-access-memory), etc. Processing circuitry in storage and processing circuitry 40 may be used in controlling the operation of device 10. The processing circuitry may be based on one or more microprocessors, microcontrollers, digital signal processors, baseband processor integrated circuits, application specific integrated circuits, etc.

With one suitable arrangement, storage and processing circuitry 40 may be used to run software on device 10 such as internet browsing applications, email applications, media playback applications, operating system functions, software for capturing and processing images, software implementing functions associated with gathering and processing sensor data, software that makes adjustments to display brightness and touch sensor functionality, etc.

To support interactions with external equipment, storage and processing circuitry 40 may be used in implementing communications protocols. Communications protocols that may be implemented using storage and processing circuitry 40 include internet protocols, wireless local area network protocols (e.g., IEEE 802.11 protocols—sometimes referred to as WiFi®), protocols for other short-range wireless communications links such as the Bluetooth® protocol, etc.

Input-output circuitry 32 may be used to allow input to be supplied to device 10 from a user or external devices and to allow output to be provided from device 10 to the user or external devices.

Input-output circuitry 32 may include wired and wireless communications circuitry 34. Communications circuitry 34 may include radio-frequency (RF) transceiver circuitry formed from one or more integrated circuits, power amplifier circuitry, low-noise input amplifiers, passive RF components, one or more antennas, and other circuitry for handling RF wireless signals. Wireless signals can also be sent using light (e.g., using infrared communications).

Input-output circuitry 32 may include input-output devices 36 such as button 22 of FIG. 2, joysticks, click wheels, scrolling wheels, a touch screen (e.g., display 14 of FIG. 1, 2, 3, or 4 may be a touch screen display), other touch sensors such as track pads or touch-sensor-based buttons, vibrators, audio components such as microphones and speakers, image capture devices such as a camera module having an image sensor and a corresponding lens system, keyboards, status-indicator lights, tone generators, key pads, and other equipment for gathering input from a user or other external source and/or generating output for a user or for external equipment.

Sensor circuitry such as sensors 38 of FIG. 5 may include an ambient light sensor for gathering information on ambient light levels, proximity sensor components (e.g., light-based proximity sensors and/or proximity sensors based on other structures), accelerometers, gyroscopes, magnetic sensors, and other sensor structures. Sensors 38 of FIG. 5 may, for example, include one or more microelectromechanical systems (MEMS) sensors (e.g., accelerometers, gyroscopes, microphones, force sensors, pressure sensors, capacitive sensors, or any other suitable type of sensor formed using a microelectromechanical systems device).

Figure 6:
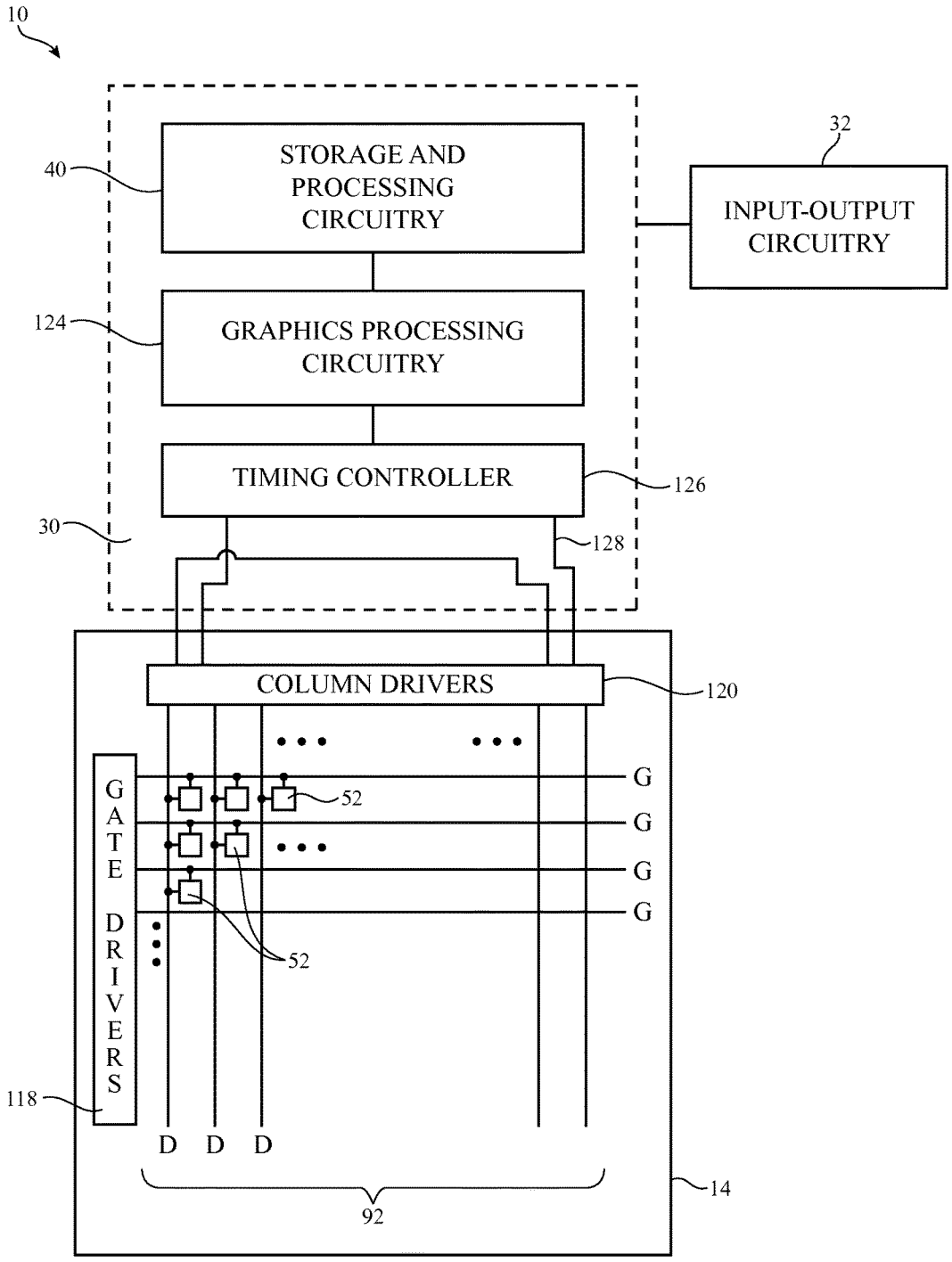
FIG. 6 is a schematic diagram of an illustrative electronic device having a display and display control circuitry in accordance with an embodiment of the present invention.

FIG. 6 is a diagram of device 10 showing illustrative circuitry that may be used in displaying images for a user of device 10 on pixel array 92 of display 14. As shown in FIG. 6, display 14 may have column driver circuitry 120 that drives data signals (analog voltages) onto the data lines D of array 92. Gate driver circuitry 118 drives gate line signals onto gate lines G of array 92. Using the data lines and gate lines, display pixels 52 may be configured to display images on display 14 for a user. Gate driver circuitry 118 may be implemented using thin-film transistor circuitry on a display substrate such as a glass or plastic display substrate or may be implemented using integrated circuits that are mounted on the display substrate or attached to the display substrate by a flexible printed circuit or other connecting layer. Column driver circuitry 120 may be implemented using one or more column driver integrated circuits that are mounted on the display substrate or using column driver circuits mounted on other substrates.

During operation of device 10, storage and processing circuitry 40 may produce data that is to be displayed on display 14. This display data may be provided to display control circuitry such as timing controller integrated circuit 126 using graphics processing unit 124.

Timing controller 126 may provide digital display data to column driver circuitry 120 using paths 128. Column driver circuitry 120 may receive the digital display data from timing controller 126. Using digital-to-analog converter circuitry within column driver circuitry 120, column driver circuitry 120 may provide corresponding analog output signals on the data lines D running along the columns of display pixels 52 of array 92.

Storage and processing circuitry 40, graphics processing unit 124, and timing controller 126 may sometimes collectively be referred to herein as display control circuitry 30. Display control circuitry 30 may be used in controlling the operation of display 14.

Display control circuitry 30 may be configured to adaptively adjust the spectral characteristics of light emitted from display 14 to achieve a desired effect on the human circadian system. For example, the human circadian rhythm may be most sensitive to wavelengths of light between 450 nm and 480 nm. When a user is exposed to light within this range of wavelengths (e.g., blue light having a wavelength of 470 nm), the user's melatonin production may be suppressed to daytime levels. On the other hand, when a user is exposed to light outside of this range of wavelengths (e.g., blue light having a different wavelength) or when blue light is suppressed (e.g., compared to red light), the user's melatonin production may be increased, signaling nighttime to the body. Display control circuitry 30 may adaptively adjust the spectral characteristics of display light emitted from display 14 (e.g., by adjusting the blue spectrum of light emitted from display 14) to achieve the desired circadian response from a user.

In one illustrative configuration, display control circuitry 30 may adjust the blue content of images displayed on display 14 based on the time of day. For example, display control circuitry 30 may increase the amount of blue light emitted from display 14 during daylight hours (e.g., to suppress melatonin production as daylight does) and may decrease the amount of blue light emitted from display 14 during evening hours (e.g., to promote melatonin production as darkness does).

In another illustrative configuration, display control circuitry may adjust the blue content of images displayed on display 14 based on user input. For example, a user may adjust a setting on device 10 to manually control the color spectrum of display 14 (e.g., to increase or decrease the amount of blue light emitted from display 14).

If desired, a user may activate a "jet-lag assistance" setting to help reduce jet-lag when traveling. In this mode, display control circuitry 30 may automatically adjust the blue content of images on display 14 when it is detected that the user is traveling (e.g., when a time zone change is detected). For example, display control circuitry 30 may automatically adjust the blue content of images on display 14 to promote melatonin production and thereby act as a sleep-aid (if so desired by the user).

As shown in FIG. 6, display control circuitry 30 may gather information from input-output circuitry 32 to adaptively determine optimal spectral characteristics for achieving the desired circadian response. For example, display control circuitry 30 may gather light information from one or more light sensors (e.g., an ambient light sensor, a light meter, a color meter, a color temperature meter, and/or other light sensor), time information from a clock, calendar, and/or other time source, location information from location detection circuitry (e.g., Global Positioning System receiver circuitry, IEEE 802.11 transceiver circuitry, or other location detection circuitry), user input information from a user input device such as a touchscreen (e.g., touchscreen display 14) or keyboard, etc. Display control circuitry 30 may adjust spectral characteristics of display light emitted from display 14 (e.g., may adjust peak wavelength or peak luminance of blue light emitted from display 14) based on information from input-output circuitry 32.

Figure 7:
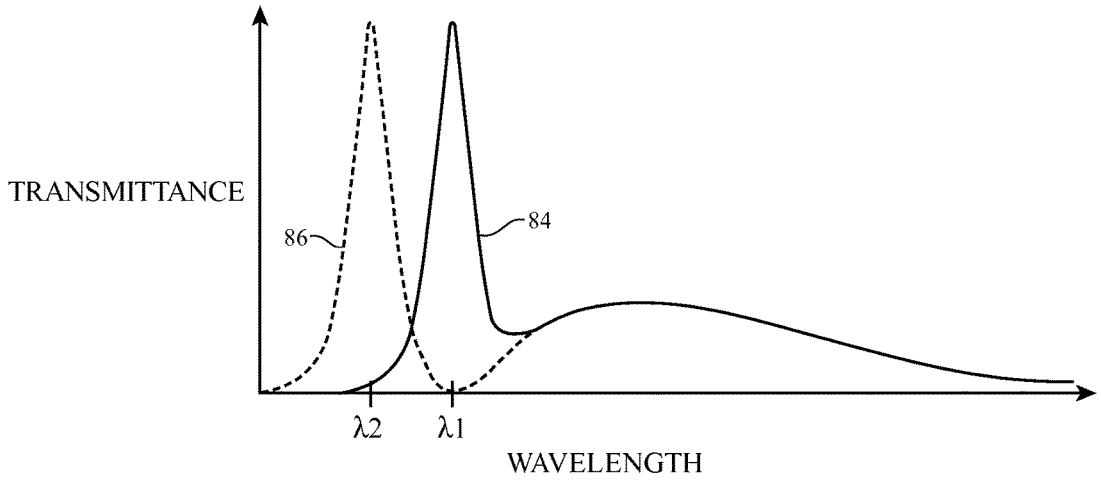
FIG. 7 is a diagram illustrating how the spectral characteristics of display light may be adjusted by shifting a peak wavelength associated with blue light emitted from the display in accordance with an embodiment of the present invention.
Figure 8:
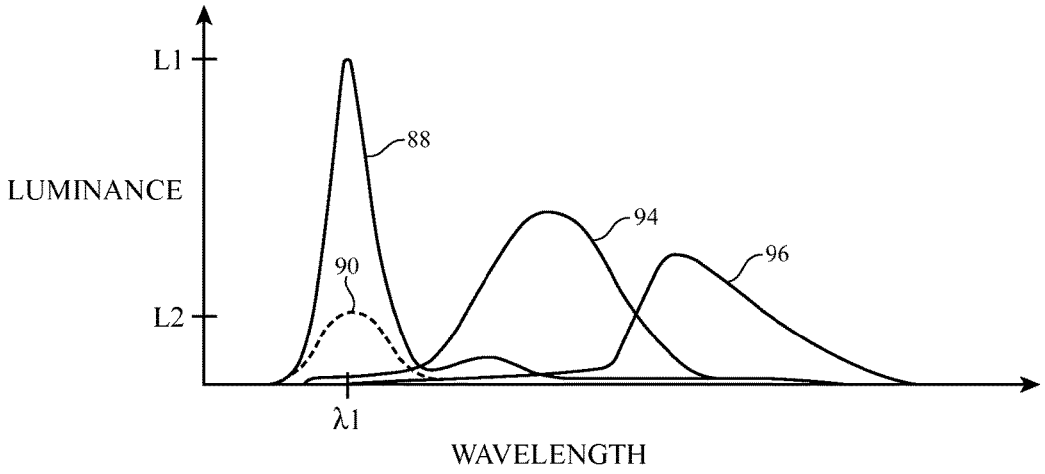
FIG. 8 is a diagram illustrating how the spectral characteristics of display light may be adjusted by attenuating the maximum luminance associated with blue light emitted from the display in accordance with an embodiment of the present invention.

Diagrams illustrating ways in which the spectral characteristics of blue light emitted from display 14 may be adjusted are shown in FIGS. 7 and 8. In the example of FIG. 7, a first color gamut may be defined by spectral distribution curve 84 having a peak at $\lambda 1$, whereas a second color gamut may be defined by spectral distribution curve 86 having a peak at $\lambda 2$. Blue light of the first color gamut may, for example, have a wavelength $\lambda 1$ between 450 nm and 480 nm, 440 nm and 480 nm, 460 nm and 490 nm, 465 nm and 485 nm, or other suitable wavelength. Blue light of the second color gamut may have a wavelength $\lambda 2$ between 400 nm and 420 nm, 400 nm and 430 nm, 400 nm and 450 nm, or other suitable wavelength. Wavelength $\lambda 1$ may be greater than wavelength $\lambda 2$.

Wavelength $\lambda 1$ may, for example, correspond to the peak spectral sensitivity of the circadian response. Exposure to blue light with peak wavelengths at $\lambda 1$ may therefore result in suppressed nocturnal melatonin. Wavelength $\lambda 2$, on the other hand, may be out of phase with the spectral sensitivity of the circadian response and may therefore result in unaffected, normal, or increased melatonin levels.

Display control circuitry 30 may switch between a first display mode in which images are displayed according to a color gamut defined by spectral distribution curve 84 and a second display mode in which images are displayed according to a color gamut defined by spectral distribution curve 86. In the first mode, blue content in the images may be in sync with the peak spectral sensitivity of the circadian response. In the second mode, blue content in the images may be out of sync with the peak spectral sensitivity of the circadian response.

If desired, the blue content of images displayed on display 14 may be adjusted by adjusting the peak luminance of blue light (e.g., without shifting the peak wavelength). This type of adjustment is illustrated in FIG. 8. In the example of FIG. 8, a first color gamut may be defined by blue spectral distribution curve 88 (having a peak wavelength at $\lambda 1$), green spectral distribution curve 94, and red spectral distribution curve 96. The peak luminance of blue spectral distribution curve 88 may correspond to luminance L1. A second color gamut may be defined by blue spectral distribution curve 90. The peak luminance of blue spectral distribution curve 90 may correspond to luminance L2 (e.g., a luminance less than L1).

Wavelength $\lambda 1$ may, for example, correspond to the peak spectral sensitivity of the circadian response. Exposure to bright blue light (e.g., blue light at luminance L1) with peak wavelengths at $\lambda 1$ may therefore result in suppressed nocturnal melatonin. A lower brightness of blue light (e.g., blue light at luminance L2), on the other hand, may result in unaffected, normal, or increased melatonin levels. If desired, luminance L1 may be lower than the peak luminance associated with red light 96.

With this type of spectral adjustment, display control circuitry 30 may switch between a first display mode in which images are displayed according to a color gamut defined by blue spectral distribution curve 88 and a second display mode in which images are displayed according to a color gamut defined by blue spectral distribution curve 90. In the first mode, blue content in the images may be in sync with the peak spectral sensitivity of the circadian response and may be bright enough to trigger a response. In the second mode, blue light may still be aligned with the peak spectral sensitivity of the circadian response (if desired) but may be sufficiently dim to avoid suppression of nocturnal melatonin.

To adjust the spectral characteristics of display light emitted from display 14 according to the method described in connection with FIG. 8, display control circuitry 30 may adjust the relative maximum power levels that display control circuitry 30 delivers to pixels 52. Maximum power levels for pixels 52 of a given color may be reduced, for example, by reducing the maximum possible digital display control value for the pixels of that color (e.g., from a maximum value of 255 to a maximum value of 251). When the blue channel of display 14 is attenuated in this way, other color channels (e.g., red and blue channels of display 14) may also be adjusted to maintain desired color characteristics for display 14 (e.g., to maintain a desired white point). If desired, a look-up table (LUT) such as a gamma LUT may be used to determine the appropriate digital display control values for display pixels 52 when the blue channel is attenuated.

If it is desired to attenuate blue light emitted from display 14 while maintaining the same number of digital display control values, the relative maximum power levels that display control circuitry 30 delivers to pixels 52 may be reduced by reducing the maximum allowable voltage with which pixels 52 in display 14 are driven. This may include, for example, adjusting the maximum allowable driving voltage for blue pixels through register settings (e.g., using a reset register).

To avoid undesirable shifts in color balance when adjusting the blue content of images on display 14, steps may be taken to ensure that perceivable shifts in the display white point do not occur. For example, when blue light is attenuated by reducing the maximum possible digital display control value for the blue pixels, the red and green channels may be adjusted accordingly to maintain the display white point on a black body curve. Maintaining the white point along a black body curve may minimize perceivable color shifts. Display control circuitry 30 may, if desired manage the color balance and white point of display 14 based on ambient lighting conditions (e.g., based on sensor data from an ambient light sensor, camera, etc.).

Figure 9:
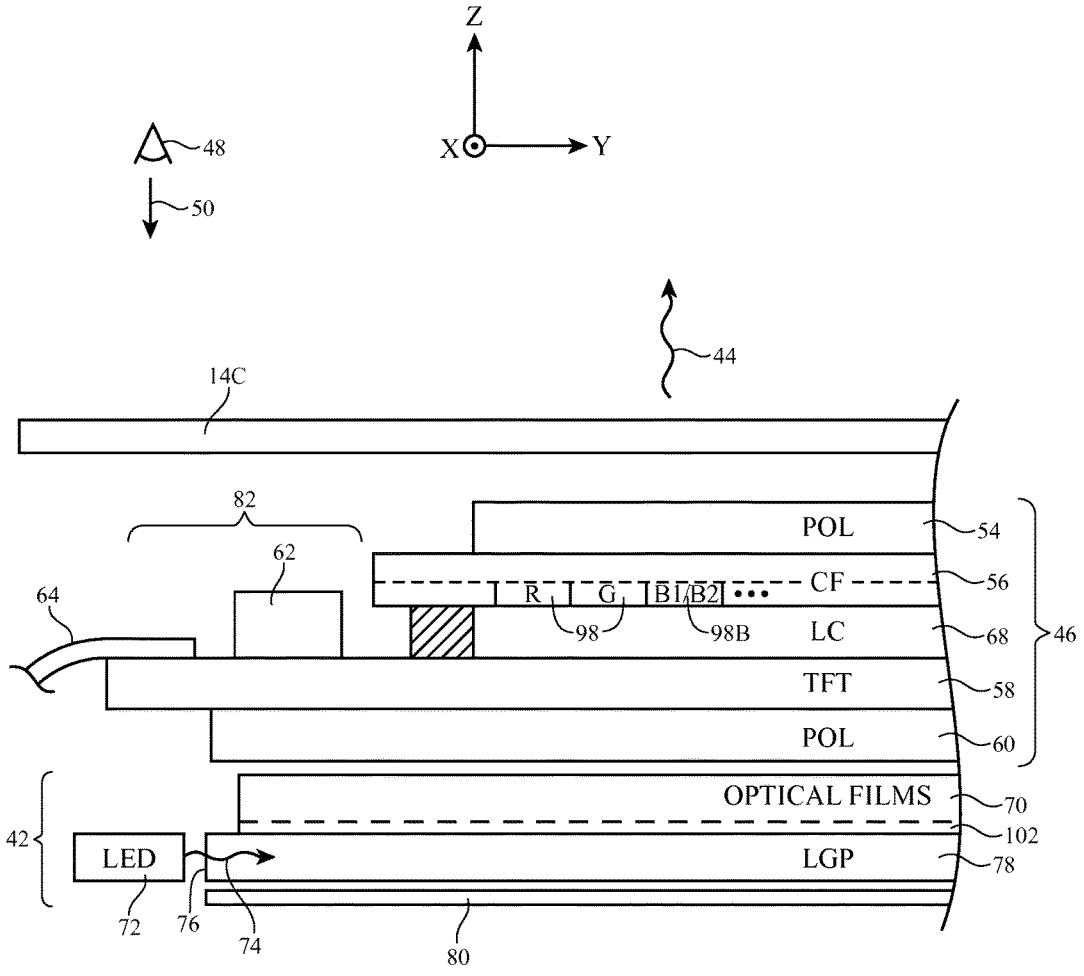
FIG. 9 is a cross-sectional view of an illustrative backlit display having one or more switchable filters for adjusting the spectral characteristics of display light in accordance with an embodiment of the present invention.

A cross-sectional side view of an illustrative configuration for display 14 of device 10 (e.g., for display 14 of the devices of FIG. 1, FIG. 2, FIG. 3, FIG. 4 or other suitable electronic devices) is shown in FIG. 9. As shown in FIG. 9, display 14 includes backlight structures such as backlight unit 42 for producing backlight 44. During operation, backlight 44 travels outwards (vertically upwards in dimension Z in the orientation of FIG. 9) and passes through display pixel structures in display layers 46. This illuminates any images that are being produced by the display pixels for viewing by a user. For example, backlight 44 illuminates images on display layers 46 that are being viewed by viewer 48 in direction 50.

Display layers 46 may be mounted in chassis structures such as a plastic chassis structure and/or a metal chassis structure to form a display module for mounting in housing 12 or display layers 46 may be mounted directly in housing 12 (e.g., by stacking display layers 46 into a recessed portion in housing 12). Display layers 46 form a liquid crystal display or may be used in forming displays of other types.

In a configuration in which display layers 46 are used in forming a liquid crystal display, display layers 46 include a liquid crystal layer such a liquid crystal layer 68. Liquid crystal layer 68 is sandwiched between display layers such as display layers 58 and 56. Layers 56 and 58 are interposed between lower polarizer layer 60 and upper polarizer layer 54.

Layers 58 and 56 are formed from transparent substrate layers such as clear layers of glass or plastic. Layers 56 and 58 are layers such as a thin-film transistor layer (e.g., a thin-film-transistor substrate such as a glass layer coated with a layer of thin-film transistor circuitry) and/or a color filter layer (e.g., a color filter layer substrate such as a layer of glass having a layer of color filter elements 98 such as red, blue, and green color filter elements arranged in an array). Conductive traces, color filter elements, transistors, and other circuits and structures are formed on the substrates of layers 58 and 56 (e.g., to form a thin-film transistor layer and/or a color filter layer). Touch sensor electrodes may also be incorporated into layers such as layers 58 and 56 and/or touch sensor electrodes may be formed on other substrates.

With one illustrative configuration, layer 58 is a thin-film transistor layer that includes an array of thin-film transistors and associated electrodes (display pixel electrodes) for applying electric fields to liquid crystal layer 68 and thereby displaying images on display 14. Layer 56 is a color filter layer that includes an array of color filter elements 98 for providing display 14 with the ability to display color images. If desired, layer 58 may be a color filter layer and layer 56 may be a thin-film transistor layer.

During operation of display 14 in device 10, control circuitry (e.g., display control circuitry 30 of FIG. 6) is used to generate information to be displayed on display 14 (e.g., display data). The information to be displayed is conveyed from the control circuitry to display driver integrated circuit 62 using a signal path such as a signal path formed from conductive metal traces in flexible printed circuit 64 (as an example).

Display driver circuitry such as display driver integrated circuit 62 of FIG. 9 is mounted on thin-film-transistor layer driver ledge 82 or elsewhere in device 10. A flexible printed circuit cable such as flexible printed circuit 64 is used in routing signals to and from thin-film-transistor layer 58. If desired, display driver integrated circuit 62 may be mounted on flexible printed circuit 64.

Backlight structures 42 include a light guide plate such as light guide plate 78. Light guide plate 78 is formed from a transparent material such as clear glass or plastic. During operation of backlight structures 42, a light source such as light source 72 generates light 74. Light source 72 may be, for example, an array of light-emitting diodes.

Light 74 from one or more light sources such as light source 72 is coupled into one or more corresponding edge surfaces such as edge surface 76 of light guide plate 78 and is distributed in dimensions X and Y throughout light guide plate 78 due to the principal of total internal reflection. Light guide plate 78 includes light-scattering features such as pits or bumps. The light-scattering features are located on an upper surface and/or on an opposing lower surface of light guide plate 78.

Light 74 that scatters upwards in direction Z from light guide plate 78 serves as backlight 44 for display 14. Light 74 that scatters downwards is reflected back in the upwards direction by reflector 80. Reflector 80 is formed from a reflective material such as a layer of white plastic or other shiny materials.

To enhance backlight performance for backlight structures 42, backlight structures 42 include optical films 70. Optical films 70 include diffuser layers for helping to homogenize backlight 44 and thereby reduce hotspots, compensation films for enhancing off-axis viewing, and brightness enhancement films (also sometimes referred to as turning films) for collimating backlight 44. Optical films 70 overlap the other structures in backlight unit 42 such as light guide plate 78 and reflector 80. For example, if light guide plate 78 has a rectangular footprint in the X-Y plane of FIG. 9, optical films 70 and reflector 80 preferably have a matching rectangular footprint.

To adjust the spectral characteristics of display light emitted from display 14 according to the method described in connection with FIG. 7, display 14 may include one or more switchable color filters. For example, backlight structures 42 may include switchable filter 102 operable in first and second filtering states. In a first state, filter 102 may pass a first range of wavelengths corresponding to a first hue of blue light (e.g., a range centered around λ1 of FIG. 7) while blocking a second range of wavelengths corresponding to a second hue of blue light (e.g., a range centered around λ2 of FIG. 7). In a second state, filter 102 may pass the second range of wavelengths corresponding to the second hue of blue light (e.g., centered around λ2 of FIG. 7) while blocking the first range of wavelengths corresponding to the first hue of blue light (e.g., centered around λ1 of FIG. 7).

Filter 102 may be a tunable filter formed from microelectromechanical systems devices, cholesteric liquid crystal, tunable photonic crystal, guest-host liquid crystal film, polymer dispersed liquid crystal, and/or other structures.

In another suitable arrangement, switchable color filters may be implemented in color filter layer 56. For example, blue color filter elements 98B may be switchable color filter elements that are operable in first and second filtering states. In a first state, filters 98B may pass a first range of wavelengths corresponding to a first hue of blue light 31 (e.g., a range centered around λ1 of FIG. 7) while blocking a second range of wavelengths corresponding to a second hue of blue light B2 (e.g., a range centered around λ2 of FIG. 7). In a second state, filters 98B may pass the second range of wavelengths corresponding to the second hue of blue light (e.g., centered around λ2 of FIG. 7) while blocking the first range of wavelengths corresponding to the first hue of blue light (e.g., centered around λ1 of FIG. 7).

Figure 10:
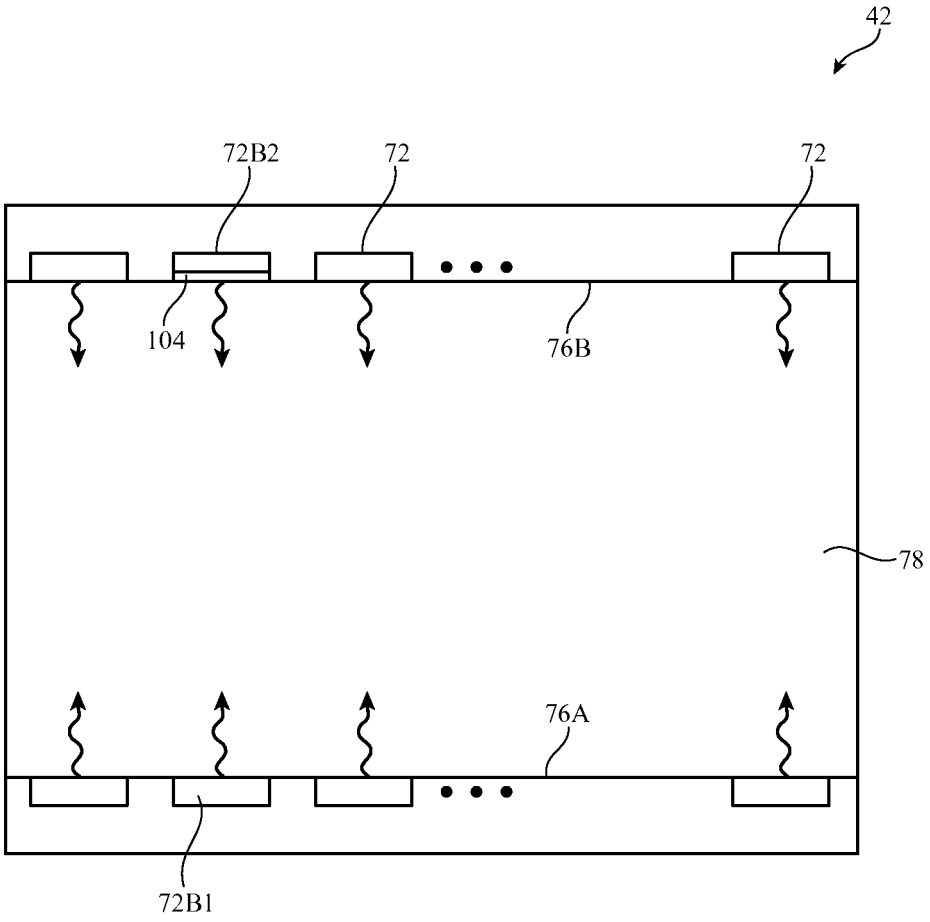
FIG. 10 is a top view of an illustrative backlight for display having light sources with distinct spectral characteristics in accordance with an embodiment of the present invention.

In another suitable arrangement, light source 72 may include light sources with distinct spectral characteristics. This example is illustrated in FIG. 10. As shown in FIG. 10, backlight structures 42 may include an array of light-emitting diodes 72. Light-emitting diodes 72B1 in backlight 42 may have a first emission spectrum, whereas light-emitting diodes 72B1 in backlight 42 may have a second emission spectrum. The blue spectrum of light emitted by light-emitting diodes 72B1 may correspond to a first hue of blue light B1 (e.g., a range centered around λ1 of FIG. 7) while the blue spectrum of light emitted by light-emitting diodes 72B2 may correspond to a second hue of blue light B2 (e.g., a range centered around λ2 of FIG. 7).

If desired, filters such as filter 104 (e.g., a bandpass filter, notch filter, or other suitable filter) may be used to adjust the spectral characteristics of light emitted by light-emitting diodes 72.

Light emitting diodes 72B1 and 72B2 may be arranged in any suitable fashion. For example, light-emitting diodes 72 that emit light into edge 76A may emit blue light of the first hue B1, whereas light-emitting diodes 72 that emit light into edge 76B may emit blue light of the second hue B2. If desired, light-emitting diodes 72B1 and 72B2 may be interlaced with each other along one or more edges of light guide plate 78 and/or may be mounted together in a single semiconductor package.

Backlight switchable filter 102, switchable color filter 98B, and distinct sources of blue light 72B1 and 72B2 are illustrative examples of structures that may be used to adjust the spectral characteristics of light emitted from display 14. These structures may be implemented together, separately, or in any combination, or other suitable structures may be used to adjust the spectral characteristics of display light in a similar manner.

Figure 11:
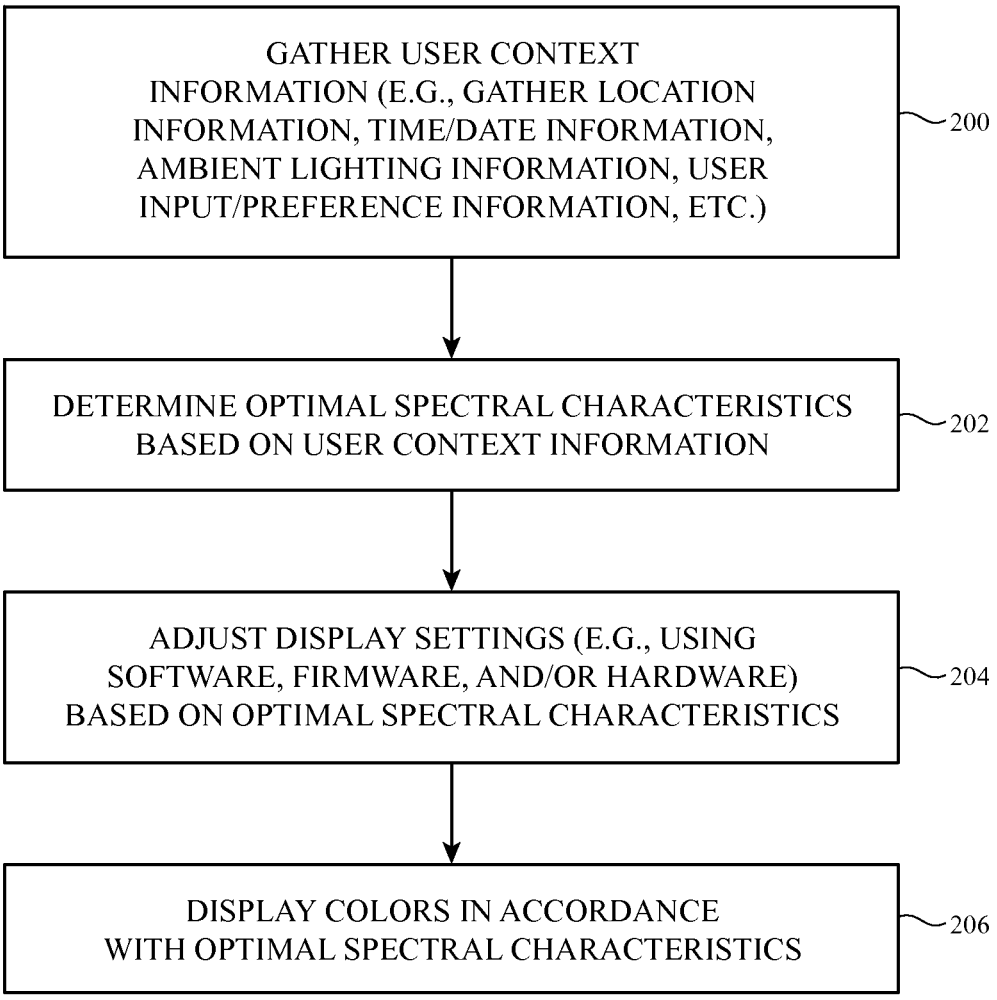
FIG. 11 is a flow chart of illustrative steps involved in adjusting the spectral characteristics of display light to achieve a desired effect on circadian rhythm in accordance with an embodiment of the present invention.

FIG. 11 is a flow chart of illustrative steps involved in adjusting the spectral characteristics of display light emitted from display 14 to achieve a desired effect on circadian rhythm.

At step 200, display control circuitry 30 may gather user context information from various sources in device 10. For example, display control circuitry 30 may gather time, date, and/or season information from a clock or calendar application on device 10, light information from one or more light sensors (e.g., an ambient light sensor, a light meter, a color meter, a color temperature meter, and/or other light sensor), location information from Global Positioning System receiver circuitry, IEEE 802.11 transceiver circuitry, or other location detection circuitry in device 10, user input information from a user input device such as a touchscreen (e.g., touchscreen display 14) or keyboard, etc.

At step 202, display control circuitry 30 may determine optimal spectral characteristics for display light based on the user context information gathered in step 200. For example, display control circuitry 30 may determine that the blue spectrum of light emitted by display 14 should be adjusted to suppress nocturnal melatonin (e.g., in accordance with spectral distribution curve 84 or 88), or display control circuitry 30 may determine that the blue spectrum of light emitted by display 14 should be adjusted to promote nocturnal melatonin (e.g., in accordance with spectral distribution curve 86 or 90).

At step 204, display control circuitry 30 may adjust display settings based on the optimal spectral characteristics determined in step 202. This may include, for example, adjusting the relative maximum power levels that display control circuitry 30 delivers to pixels 52 (e.g., by adjusting the maximum possible digital display control value provided to pixels 52 or by reducing the maximum allowable pixel driving voltage through register settings). If using hardware to adjust the spectral distribution of display light in accordance with FIG. 7, step 204 may include adjusting a switchable filter in display 14 (e.g., filter 102 or filter 98B) or may include adjusting backlight 42 to activate one set of light-emitting diodes (e.g., light-emitting diodes 72B1) and to deactivate another set of light-emitting diodes (e.g., light-emitting diodes 72B2).

At step 204, display 14 may display colors with the optimal spectral characteristics (e.g., the optimal spectral characteristics for achieving the desired effect on the circadian rhythm as determined by user context information).

The foregoing is merely illustrative of the principles of this invention and various modifications can be made by those skilled in the art without departing from the scope and spirit of the invention. The foregoing embodiments may be implemented individually or in any combination.

What is claimed is:

1. A method for displaying images on an array of display pixels in a display having a white point, wherein the array of display pixels includes blue display pixels, the method comprising:

with display control circuitry, gathering time of day information from a time source; and adjusting spectral characteristics of display light emitted from the display based on the time of day information while maintaining the white point of the display on a black body curve, wherein adjusting the spectral characteristics of the display light comprises adjusting an overall intensity of blue light emitted from the display based on the time of day information, and wherein adjusting the overall intensity of blue light emitted from the display comprises adjusting maximum power levels delivered to the blue display pixels without shifting a peak wavelength of the blue light.

2. The method defined in claim 1 further comprising:

determining a daylight level based on the time of day information; and adjusting the spectral characteristics of blue light emitted from the display based on the daylight level.

3. The method defined in claim 2 wherein adjusting the spectral characteristics of the blue light emitted from the display comprises attenuating the blue light emitted from the display based on the time of day information.

4. The method defined in claim 1 wherein adjusting the spectral characteristics of the display light based on the time of day information comprises:

determining whether the time of day information is associated with daylight hours or nighttime hours; and in response to determining that the time of day information is associated with nighttime hours, setting a maximum luminance for blue light at a level that is lower than that used during daylight hours.

5. A method for displaying images on an array of display pixels in a display having a white point, wherein the array of display pixels includes blue display pixels, the method comprising:

with location detection circuitry, gathering geographic location information;

with a light sensor, gathering ambient lighting information; and adjusting spectral characteristics of display light emitted from the display based on the geographic location information and the ambient lighting information while maintaining the white point of the display on a black body curve, wherein adjusting the spectral characteristics of the display light comprises adjusting an overall intensity of blue light emitted from the display based on the geographic location information and the ambient light information, and wherein adjusting the overall intensity of blue light emitted from the display comprises adjusting maximum power levels delivered to the blue display pixels without shifting a peak wavelength of the blue light emitted from the display.

6. The method defined in claim 5 further comprising:

determining a daylight level based on the geographic location information and the ambient lighting information; and adjusting the spectral characteristics of the blue light emitted from the display based on the daylight level.

7. The method defined in claim 6 wherein adjusting the spectral characteristics of the blue light emitted from the display comprises attenuating the blue light emitted from the display based on the daylight level.

8. The method defined in claim 7 wherein the display pixels include blue display pixels and wherein adjusting the spectral characteristics of the display light comprises adjusting maximum power levels delivered to the blue display pixels based on the daylight level.

9. A method for displaying images on an array of display pixels in a display having a white point, wherein the array of display pixels comprises blue display pixels, the method comprising:

with control circuitry, determining a daylight level; and adjusting spectral characteristics of blue light emitted from the display based on the daylight level while maintaining the white point of the display on a black body curve, wherein adjusting the spectral characteristics of the blue light emitted from the display comprises adjusting an overall intensity of the blue light based on the daylight level, and wherein adjusting the overall intensity of the blue light comprises adjusting maximum power levels delivered to the blue pixels without shifting a peak wavelength of the blue light emitted from the display.

10. The method defined in claim 9 wherein determining the daylight level comprises:

gathering ambient lighting information from a light sensor; and determining the daylight level based on the ambient lighting information.

11. The method defined in claim 9 wherein determining the daylight level comprises:

gathering time of day information from a time source;

gathering geographic location information from location detection circuitry; and determining the daylight level based on the time of day information and the geographic location information.

* * * * *